US009447673B2

(12) United States Patent
Medvedev et al.

(10) Patent No.: US 9,447,673 B2
(45) Date of Patent: Sep. 20, 2016

(54) METHODS FOR PROVIDING PROPPANT SLUGS IN FRACTURING TREATMENTS

(75) Inventors: Anatoly Vladimirovich Medvedev, Moscow (RU); Oleg Medvedev, Kyiv (UA); Alexander Vuacheslavovich Mikhaylov, Berdek (RU); Christopher N. Fredd, Westfield, NY (US); Kreso Kurt Butula, Zagreb (HR); John Lassek, Katy, TX (US); J. Ernest Brown, Fort Collins, CO (US); Konstantin Mikhailovich Lyapunov, Novosibirsk (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 13/698,042

(22) PCT Filed: May 17, 2010

(86) PCT No.: PCT/RU2010/000246

§ 371 (c)(1),
(2), (4) Date: Dec. 12, 2012

(87) PCT Pub. No.: WO2011/145965

PCT Pub. Date: Nov. 24, 2011

(65) Prior Publication Data

US 2013/0105166 A1 May 2, 2013

(51) Int. Cl.
*E21B 43/267* (2006.01)
*E21B 21/06* (2006.01)

(52) U.S. Cl.
CPC ..... *E21B 43/267* (2013.01); *E21B 21/062* (2013.01)

(58) Field of Classification Search
CPC ..... E21B 43/129; E21B 33/138; F15D 1/001
See application file for complete search history.

(56) References Cited

U.S. PATENT DOCUMENTS

| | | | |
|---|---|---|---|
| 3,675,827 | A | 7/1972 | Bailly |
| 3,929,191 | A | 12/1975 | Graham et al. |
| 3,937,283 | A | 2/1976 | Blauer et al. |
| 4,143,715 | A | 3/1979 | Pavlich |

(Continued)

FOREIGN PATENT DOCUMENTS

| | | |
|---|---|---|
| CN | 2204898 Y | 8/1995 |
| WO | 2006/059055 | 6/2006 |

(Continued)

OTHER PUBLICATIONS

Encyclopedia of Chemical Technology, edited by Raymond E Kirk and Donald F. Othmer, 3rd Edition, John Wiley & Sons, vol. 16, pp. 248-273.

(Continued)

*Primary Examiner* — Catherine Loikith
*Assistant Examiner* — Ashish Varma
(74) *Attorney, Agent, or Firm* — Andrea E. Tran; Tim Curington

(57) ABSTRACT

A proppant pack may be formed in a fracture that extends from a wellbore formed in a subterranean formation and is accomplished through different methods. The methods involve providing multiple spaced apart proppant slugs within a hydraulic fracturing fluid that is introduced into the wellbore at a pressure above the fracturing pressure of the formation.

16 Claims, 5 Drawing Sheets

(56) References Cited

U.S. PATENT DOCUMENTS

| | | | | |
|---|---|---|---|---|
| 4,585,064 | A | 4/1986 | Graham | |
| 4,701,095 | A | 10/1987 | Berryman et al. | |
| 4,850,750 | A | 7/1989 | Cogbill et al. | |
| 5,422,183 | A | 6/1995 | Sinclair et al. | |
| 5,424,285 | A * | 6/1995 | Stacy | C09K 8/685 166/308.6 |
| 5,441,340 | A | 8/1995 | Cedillo et al. | |
| 6,193,402 | B1 | 2/2001 | Grimland et al. | |
| 6,435,277 | B1 | 8/2002 | Qu et al. | |
| 6,703,352 | B2 | 3/2004 | Dahayanake et al. | |
| 7,114,560 | B2 * | 10/2006 | Nguyen et al. | 166/249 |
| 7,451,812 | B2 | 11/2008 | Cooper et al. | |
| 7,516,792 | B2 | 4/2009 | Lonnes et al. | |
| 7,581,590 | B2 | 9/2009 | Lesko et al. | |
| 2005/0109715 | A1 * | 5/2005 | Stoy | B01D 21/245 210/787 |
| 2006/0169064 | A1 * | 8/2006 | Anschutz | G01N 1/2202 73/863.21 |
| 2007/0277982 | A1 | 12/2007 | Shampine et al. | |
| 2008/0066911 | A1 | 3/2008 | Luharuka et al. | |
| 2008/0135242 | A1 | 6/2008 | Lesko et al. | |
| 2008/0149329 | A1 * | 6/2008 | Cooper | E21B 43/267 166/250.01 |
| 2008/0165613 | A1 | 7/2008 | Dykstra | |

FOREIGN PATENT DOCUMENTS

| | | | |
|---|---|---|---|
| WO | 2007086771 | A1 | 8/2007 |
| WO | 2008/147241 | | 12/2008 |
| WO | 2009/005387 | | 1/2009 |
| WO | 2009/096805 | | 8/2009 |
| WO | 2009/126057 | | 10/2009 |

OTHER PUBLICATIONS

Examination Report issued in Australian Patent Application No. AU2010353524 on Apr. 10, 2014, 4 pages.

Office Action issued in Columbian Patent Application No. CO12228362 on Mar. 14, 2014, 6 pages.

Examination Report issued in Gulf Cooperation Council Patent Application No. GC201118399 on Oct. 28, 2014, 4 pages.

International Search Report issued in PCT/RU2010/000246 on Feb. 17, 2011, 1 page.

Reidenbach, et al., "Mixing System for Fracturing Slurries", SPE 20131—Permian Basin Oil and Gas Recovery Conference, Midland, Texas, 1990.

* cited by examiner

METHODS FOR PROVIDING PROPPANT SLUGS IN FRACTURING TREATMENTS

BACKGROUND

The statements in this section merely provide background information related to the present disclosure and may not constitute prior art.

In the construction and development of wells formed in subterranean formations, such as wells for the production of oil and gas, various operations are carried out that require the introduction of fluids of different types into the wellbore and/or into formation surrounding the wellbore.

Hydraulic fracturing is one such operation conducted in wells that is used to increase the production of fluids from the subterranean formations. Hydraulic fracturing involves introducing fluids into the wellbore at very high flow rates and pressures to facilitate cracking and fracturing of the surrounding formation. The fracturing fluid injection rate exceeds the filtration rate into the formation so that the pressure increases at the rock face. Once the pressure exceeds the fracturing pressure threshold of the rock, the formation cracks and the fracture begins to propagate as the injection of the fracturing fluid continues.

In hydraulic fracturing, generally a proppant is introduced into the formation with the fracturing fluids at certain stages of the fracturing operation. Typically, the proppant is admixed with the fracturing fluid continuously during the treatment. The proppant (e.g. sand) is deposited in the formed fractures of the formation so the proppant prevents the fracture from closing when the pressure is reduced. This allows reservoir fluids to flow from the formation through the fractures to the wellbore so that they can be produced. Various methods exist for fracturing such formations.

Recently, techniques have been developed to provide heterogeneous proppant placement in the fracture. While heterogeneous proppant placement in hydraulic fracturing is known, methods of providing proppant slugs in fracturing fluids to provide heterogeneous proppant placement within the fractures of the formation are still in need of development.

SUMMARY

A proppant pack is placed into a fracture that extends from a wellbore formed in a subterranean formation. This is accomplished by performing different operations that facilitate providing multiple spaced apart proppant slugs within a hydraulic fracturing fluid that is introduced into the wellbore at a pressure above the fracturing pressure of the formation.

In one operation a hopper containing proppant is provided having a controllable metering unit that can be opened and closed between closed and variable open positions. The metering unit selectively meters proppant from the hopper to a variable speed conveyer in discrete, spaced apart proppant groups. The proppant groups are delivered by the conveyer to a mixing tank where the proppant is combined with the hydraulic fracturing fluid. The size and spacing of the proppant groups is controlled by a combination of the metering unit and the speed of the variable speed conveyor.

In another operation, proppant is provided to a variable speed rotating auger conveyor. The auger conveyor has a discharge that discharges conveyed proppant to a mixing tank. The auger is rotated and stopped at intervals to provide discrete proppant groups that are discharged to the mixing tank.

The multiple spaced apart proppant slugs may also be created by providing a pre-mixed proppant slurry and a clean fluid that form the fracturing fluid and at least one of a) alternating the flow of the pre-mixed proppant slurry and the clean fluid and b) pulsing one of the pre-mixed proppant slurry and clean fluid into the other. The pre-mixed proppant slurry and the clean fluid may each be pumped through different pumps or through the same pump.

The at least one of a) alternating the flow of the pre-mixed proppant slurry and the clean fluid and b) pulsing one of the pre-mixed proppant slurry and clean fluid into the other may also be accomplished by the use of one or more control valves, which may include a back pressure regulator valve. The back pressure regulator valve may be used with each of the pre-mixed proppant slurry and the clean fluid to facilitate the at least one of a) alternating the flow of the pre-mixed proppant slurry and the clean fluid and b) pulsing one of the pre-mixed proppant slurry and clean fluid into the other. The back pressure regulator valve may be used with one of the pre-mixed proppant slurry and the clean fluid and a non-back pressure regulator valve may be used with the other the fluid to facilitate the at least one of a) alternating the flow of the pre-mixed proppant slurry and the clean fluid and b) pulsing one of the pre-mixed proppant slurry and clean fluid into the other.

In other embodiments, the at least one of a) alternating the flow of the pre-mixed proppant slurry and the clean fluid and b) pulsing one of the pre-mixed proppant slurry and clean fluid into the other may be accomplished by the use of a three-way valve. The three-way valve may include a valve housing having at least two flow passages, with each flow passage allowing the passage of one of the proppant slurry and the clean slurry. A valve closure of the three-way valve may rotate about an axis substantially parallel to the fluid flow through the passages to selectively close the fluid passages.

In other embodiments, diluted proppant slurry is introduced into an inlet of a hydrocyclone separator. The hydrocyclone separator has an underflow outlet and overflow outlet wherein the pre-mixed proppant slurry is provided from at least one of the underflow outlet and overflow outlet. The clean fluid may be formed from the diluted proppant slurry and the multiple spaced apart proppant slugs are provided by controlling the flow of fluid through at least one of the underflow outlet and the overflow outlet. In another embodiment, the pre-mixed proppant slurry may be delivered by a piston pump.

In one embodiment, a proppant pack is placed into a fracture that extends from a wellbore formed in a subterranean formation by providing a proppant in a pre-mixed proppant slurry and a clean fluid that form the fracturing fluid. The method requires at least one of a) alternating the flow of the pre-mixed proppant slurry and the clean fluid and b) pulsing one of the pre-mixed proppant slurry and clean fluid into the other to facilitate providing multiple spaced apart proppant slugs within a hydraulic fracturing fluid that is introduced into the wellbore at a pressure above the fracturing pressure of the formation.

In another embodiment, a method of fracturing a subterranean formation is presented that involves pumping a hydraulic fracturing fluid at sufficient pressure to fracture the subterranean formation, the fracturing fluid comprising multiple proppant slugs spaced apart. The proppant slugs may be generated by providing a hopper containing proppant having a metering unit that selectively meters proppant from the hopper to a conveyer for delivery in discrete, spaced apart proppant groups to a mixing tank where the proppant is combined with the hydraulic fracturing fluid. The proppant slugs may be generated by a rotating auger conveyor, the auger conveyor having a discharge that discharges conveyed proppant to a mixing tank, the auger being rotated and fully stopped at intervals to provide discrete proppant groups that are discharged to the mixing tank. The proppant slugs may be provided by alternating the flow of the pre-mixed proppant slurry and the clean fluid or pulsing one of the pre-mixed proppant slurry and clean fluid into the other.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
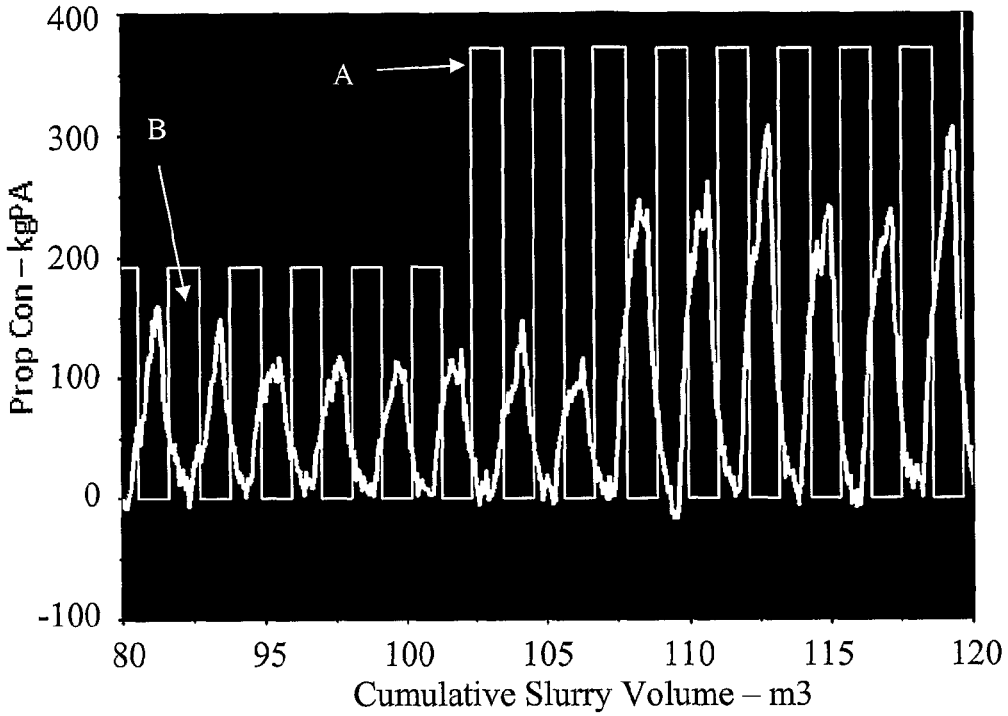
FIG. 1 is a plot of actual proppant slug concentration contrasted with an ideal target proppant slug concentration according to a given pumping schedule.

The description and examples are presented solely for the purpose of illustrating the different embodiments of the invention and should not be construed as a limitation to the scope and applicability of the invention. While any compositions of the present invention may be described herein as comprising certain materials, it should be understood that the composition could optionally comprise two or more chemically different materials. In addition, the composition can also comprise some components other than the ones already cited. While the invention may be described in terms of treatment of vertical wells, it is equally applicable to wells of any orientation. The invention will be described for hydrocarbon production wells, but it is to be understood that the invention may be used for wells for production of other fluids, such as water or carbon dioxide, or, for example, for injection or storage wells. It should also be understood that throughout this specification, when a concentration or amount range is described as being useful, or suitable, or the like, it is intended that any and every concentration or amount within the range, including the end points, is to be considered as having been stated. Furthermore, each numerical value should be read once as modified by the term "about" (unless already expressly so modified) and then read again as not to be so modified unless otherwise stated in context. For example, "a range of from 1 to 10" is to be read as indicating each and every possible number along the continuum between about 1 and about 10. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range.

Heterogeneous proppant placement within fractures of a subterranean formation may be provided by pumping alternate stages of proppant-laden and clean or proppant-free fluids. This can be accomplished by controlling the delivery of proppant so that it is integrated into the fracturing fluid at the surface and thereby forms proppant slugs to facilitate heterogeneous proppant placement within the fractures when introduced into the formation. Examples of such heterogeneous proppant placement are described in U.S. Pat. Nos. 7,451,812 and 7,581,590 and in International Publication No. WO2009/005387, each of which is incorporated herein in its entirety.

As used herein, the expression "clean fluid" or similar expressions is meant to encompass a fluid that is substantially free of proppant or that may have a significantly lower amount or concentration of proppant than a proppant slurry. Likewise, the expression "proppant slurry" or "proppant-laden fluid" is meant to encompass a fluid that contains a significant amount of proppant to facilitate formation of a proppant slug. The concentration of proppant for the proppant slug is always higher than for the proppant concentration of the adjacent clean fluid slug and may be from 5, 10, 20, 50 or 100 times higher or more than the proppant concentration of the clean fluid, when the clean fluid contains an amount of proppant.

In conventional viscosified hydraulic fracturing fluids, the clean fluid may have proppant in an amount of from 0 to about 2 pounds per gallon (PPA) of fluid or from 0 to about 0.24 kg/L. In contrast, the proppant slug for a hydraulic fracturing fluid may contain proppant in an amount of from about 0.1 PPA (0.01 kg/L) to about 20 PPA (2.4 kg/L) or more. Typically, the proppant slug will have a proppant concentration of from about 1 PPA (0.12 kg/L) to about 12 PPA (1.4 kg/L). In other fracturing fluids, such as thin water or slick-water fluids that are used in treating tight shale formations where the fluid contains little or no polymer or viscosifying agent, the clean fluid may have a proppant concentration of 0 to about 0.1 PPA (0.1 kg/L), with the proppant slug having a proppant concentration of from about 0.1 PPA (0.1 kg/L) to about 2 PPA (0.24 kg/L). The proppant materials may be construed to be any particulate materials that are introduced into a fracture to facilitate keeping the fracture open. The term "proppant" is intended to include sand, gravel, glass beads, polymer beads, ground products from shells and seeds such as walnut hulls, manmade materials such as ceramic proppant in this discussion. The proppant may be coated with, for example, resin, adhesive, or tackifier coating. In general the proppant used may have an average particle size of from about 0.15 mm to about 2.5 mm, more particularly, but not limited to typical size ranges of about 0.25-0.43 mm, 0.43-0.85 mm, 0.85-1.18 mm, 1.18-1.70 mm, and 1.70-2.36 mm.

The proppant particles may be substantially insoluble in the fluids of the formation. Any proppant can be used, provided that it is compatible with the formation, the fluid, and the desired results of the treatment. The proppants may be natural or synthetic, coated, or contain chemicals; more than one type of proppant can be used sequentially or in mixtures and the proppant particles may be of different sizes or different materials. Proppants and gravels in the same or different wells or treatments can be the same material and/or the same size as one another. The proppant may be selected based on the rock strength, injection pressures, types of injection fluids, or even completion design. The proppant materials may include, but are not limited to, sand, sintered bauxite, glass beads, ceramic materials, naturally occurring materials, or similar materials. Naturally occurring materials may be underived and/or unprocessed naturally occurring materials, as well as materials based on naturally occurring materials that have been processed and/or derived. Suitable examples of naturally occurring particulate materials for use as proppants include, but are not necessarily limited to: ground or crushed shells of nuts such as walnut, coconut, pecan, almond, ivory nut, brazil nut, etc.; ground or crushed seed shells (including fruit pits) of seeds of fruits such as plum, olive, peach, cherry, apricot, etc.; ground or crushed seed shells of other plants such as maize (e.g., corn cobs or corn kernels), etc.; processed wood materials such as those derived from woods such as oak, hickory, walnut, poplar, mahogany, etc., including such woods that have been processed by grinding, chipping, or other form of particalization, processing, etc. Further information on some of the above-noted compositions thereof may be found in Encyclopedia of Chemical Technology, Edited by Raymond E. Kirk and Donald F. Othmer, Third Edition, John Wiley & Sons, Volume 16, pages 248-273 (entitled "Nuts"), Copyright 1981, which is incorporated herein by reference. In certain embodiments, the proppant may be formed from non-fly ash materials.

All or some of the proppant materials may be provided with adhesive properties as well, which may be added at a manufacturing facility or on the fly while being mixed with treatment fluids at the wellsite. The adhesive properties may be provided by a coating, such as resin coating, that is added at a manufacturing facility or on the fly while being mixed with treatment fluids at the wellsite. The adhesive properties may be provided by a resin coating. The resins used may include, for example, epoxy, phenolic (e.g. phenol formaldehyde), polyurethane elastomers, amino resins, polyester resins, acrylic resins, etc. Examples of resin coated particles are described in U.S. Pat. Nos. 3,929,191, 4,585,064 and 5,422,183, which are each herein incorporated by reference in their entireties. The coating thickness may vary, but resin coatings that make up of from about 1 to about 99% by total weight of resin coated proppant (RCP) may be used, more particularly from about 1 to about 50% by total weight of RCP.

The resin coated proppants may be coated particles where the resin is initially uncured when the proppant slurry is initially formed. The non-cured (often referred to as curable) RCP may initially be generally solid and nontacky at surface conditions, thus facilitating handling and preparation of the proppant slurry, as the proppant particles do not tend to stick together. Upon introduction into the fracture in the subterranean formation, the resin will soften due to the higher temperatures encountered. Subsequently, the resin cures or crosslinks so that it becomes hard and infusible, with some flexibility. Typical temperatures that facilitate curing range from about 40° C. to about 250° C. At lower temperatures, i.e. temperatures of less than about 60° C., curing aids may be used to provide sufficient consolidation within a reasonable length of time. Such curing aids are known by those skilled in the art and may include, for example, isopropanol, methanol and surfactants with alcoholic compounds.

Curing or crosslinking of the resin may occur merely due to heating. The resin may be selected so that curing occurs at particular temperatures and so that certain time periods may be required for curing to ensure that the resin does not cure too quickly. Resins having cure times of from about 1 hour to about 75 hours or more may be used to ensure that sufficient time is allowed for positioning of the proppant pack.

Pre-cured resin coated proppants includes those resin coated proppant particles where the resin has been at least partially cured or crosslinked at the surface prior to introduction into the well or fracture. Such pre-cured RCP may be particularly useful with fracturing fluids because they do not require temperature for activation. The pre-cured resin coated proppant particles may only interact physically with each other, with no chemical bonding. As a result. a thicker resin coating may be required compared to uncured RCP. The coatings used may be flexible ones that can be easily deformed under pressure. This coupled with thicker coating on the proppant surface may give rise to stronger interactions between particles. Such materials included rubbers, elastomers, thermal plastics or plastics. The adhesive material of the proppant materials may facilitate aggregation of the proppant materials. The proppant may also have self-aggregation properties. In certain embodiments, an adhesive material may be added that wets or coats the proppant materials. The proppant used comprise a single type of proppant or a mixture of more than one type of proppant with varied properties. Proppant properties that may be varied include for example density, mesh size, shape or geometry, chemical composition, and uniformity. Mixtures of proppant type, property, or size may be selected for particular wellbore conditions or reservoir properties.

Examples of suitable commercially available non-cured resin coated particles include Super HS, Super LC, Super TF, Super HT, MagnaProp, DynaProp, Opti Prop and PolaProp, all available from Santrol, Inc., Fresno, Calif. and Ceramax resin coated proppants, available from Borden Chemical, Columbus, Ohio. The resin coated particles may also include particles having a tackifying or similar coating that provides similar characteristics to the RCP previously described, such as the coated sand, which may be added on the fly to the proppant slurry. Alternatively, chemical coatings to provide desired properties, such as tackiness, adhesion, or variable wettability may be added to the proppant on the fly.

The fracturing fluids and systems used for carrying out the hydraulic fracturing are typically aqueous fluids, but could also include fluids made from a hydrocarbon base or emulsion fluid. The fracturing fluids could be foamed or emulsified using nitrogen or carbon dioxide. The aqueous fluid may include fresh water, sea water, salt solutions or brines. The aqueous fluids for both the proppant slurry and the clean fluid are typically viscosified so that they have sufficient viscosities to carry or suspend the proppant materials, prevent fluid leak off, etc. In order to provide the higher viscosity to the aqueous fracturing fluids, water soluble or hydratable polymers are often added to the fluid. These polymers may include, but are not limited to, guar gums, high-molecular weight polysaccharides composed of mannose and galactose sugars, or guar derivatives such as hydropropyl guar (HPG), carboxymethyl guar (CMG), and carboxymethylhydroxypropyl guar (CMHPG). Cellulose derivatives such as hydroxyethylcellulose (HEC) or hydroxypropylcellulose (HPC) and carboxymethylhydroxyethylcellulose (CMHEC) may also be used. Any useful polymer may be used in either crosslinked form, or without crosslinker in linear form. Xanthan, diutan, and scleroglucan, three biopolymers, have been shown to be useful as viscosifying agents. Synthetic polymers such as, but not limited to, polyacrylamide and polyacrylate polymers and copolymers are used typically for high-temperature applications or for the purpose of providing friction reduction.

In some embodiments of the invention, a viscoelastic surfactant (VES) is used as the viscosifying agent for the aqueous fluids. The VES may be selected from the group consisting of cationic, anionic, zwitterionic, amphoteric, nonionic and combinations thereof. Some nonlimiting examples are those cited in U.S. Pat. Nos. 6,435,277 and 6,703,352, each of which is incorporated herein by reference. The viscoelastic surfactants, when used alone or in combination, are capable of forming micelles that form a structure in an aqueous environment that contribute to the increased viscosity of the fluid (also referred to as "viscosifying micelles"). These fluids are normally prepared by mixing in appropriate amounts of VES suitable to achieve the desired viscosity. The viscosity of VES fluids may be attributed to the three dimensional structure formed by the components in the fluids. When the concentration of surfactants in a viscoelastic fluid significantly exceeds a critical concentration, and in most cases in the presence of an electrolyte, surfactant molecules aggregate into species such as micelles, which can interact to form a network exhibiting viscous and elastic behavior.

The fluids may also contain a gas component. The gas component may be provided from any suitable gas that forms an energized fluid or foam when introduced into the aqueous medium. See, for example, U.S. Pat. No. 3,937,283 (Blauer et al.), herein incorporated by reference. The gas component may comprise a gas selected from nitrogen, air, argon, carbon dioxide, and any mixtures thereof. Particularly useful are the gas components of nitrogen or carbon dioxide, in any quality readily available. The treatment fluid may contain from about 10% to about 90% volume gas component based upon total fluid volume percent, more particularly from about 20% to about 80% volume gas component based upon total fluid volume percent, and more particularly from about 30% to about 70% volume gas component based upon total fluid volume percent.

In certain embodiments, the treatment fluid may be used in fracturing tight or low-permeable formations, such as tight shale, carbonate, sandstone and mixed formations. Such formations may have a permeability of from about 1 mD or 0.5 mD or less. In such fracturing operations, water, which may be combined with a friction reducing agent in the case of slickwater, is introduced into the formation at a high rate to facilitate fracturing the formation. Often, polyacrylamides are used as the friction-reducing polymer. These fracturing fluids may use lighter weight and significantly lower amounts of proppant than conventional viscosified fracturing fluids. In water or slickwater fracturing, the proppant slurry may contain from about 0.1 PPA (0.01 kg/L) to about 2 PPA (0.24 kg/L) or proppant, with the clean fluid containing from 0 to 0.1 PPA (0.01 kg/L) proppant. The high pumping or flow rate of these fluids may also facilitate the suspension of the proppant materials. The water used for such fracturing treatments may be formed from fresh water, sea water, brine or a salt solution.

To provide the most effective heterogeneous proppant placement, it is beneficial to create a proppant pulse or slug with as ideal a shape as possible. The ideal shape of a proppant slug or pulse is considered to be that having a concentration with sharp front and back edges, as shown by the squared proppant pulses indicated at A of FIG. 1, which illustrates an ideal proppant concentration target. In actuality, the proppant slug or pulse concentrations may not meet that target as shown by the proppant profile B, due to an inadequate proppant feeding system and proppant inertia. It is known that a proppant feeding system cannot start or stop immediately, which creates a transient region in proppant concentration (i.e. non-ideal shape of the proppant pulse). Therefore, the transient time of starting, and stopping of proppant feeding should be minimized.

Figure 2:
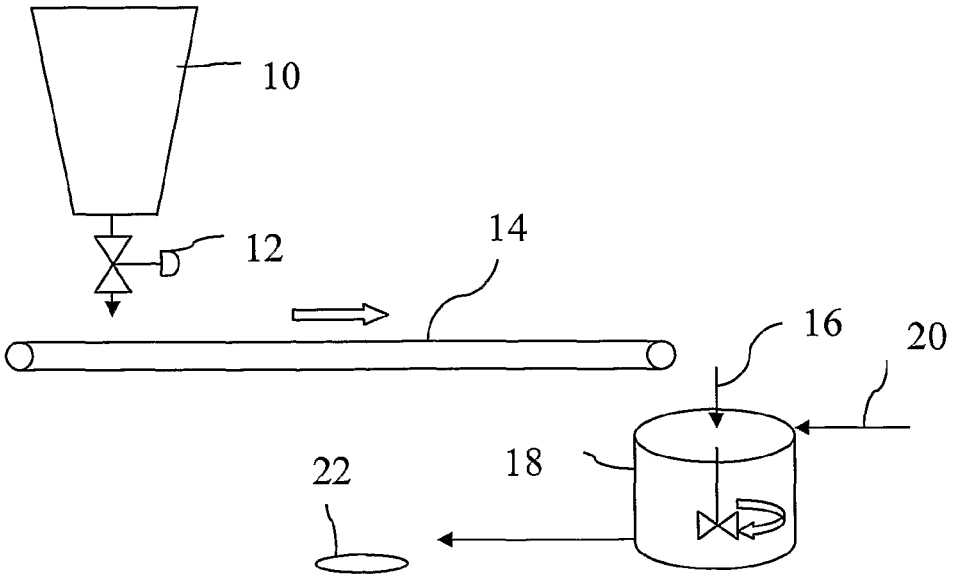
FIG. 2 is a schematic of a proppant feed system utilizing a proppant hopper and metering system in conjunction with a conveyor for delivering proppant in pulses in a fracturing fluid.

In order to create the heterogeneous proppant placement within fractures of a subterranean formation, alternate stages of proppant-laden and clean or proppant-free fluids are created at the surface with as little transient time of starting and stopping of the proppant feeding as possible prior to introduction of the fracturing fluid into the wellhead of the wellbore. Referring to FIG. 2, in a first embodiment, the alternating proppant-laden and clean fluid slugs may be formed by providing a proppant hopper or other storage unit 10 having an outlet to which the proppant is fed, such as through gravity feed. The delivery of proppant from the hopper outlet is metered or controlled with a metering unit or valve 12 to a conveyor 14. As used herein, a metering unit includes any device that is capable of regulating the flow of proppant from a storage unit or area into the fracturing fluid. A metering unit may be controlled by a variety of methods ranging from manual operation to semi-automatic operation to fully-automated activation using an overall control process. The metering unit 12 may be a hopper gate, star feeder, valve or other device that provides controlled quantities of proppant to be dispensed from the hopper 10. The metering unit 12 may provide variable metering wherein different amounts of proppant are metered when the metering unit 12 is between a fully open and a fully closed position. The metering unit 12 and conveyor 14 may be remotely controlled.

The conveyor 14 may be a belt conveyor or other conveyor that may be operable at various speeds and be controllable so that it can be started and stopped as necessary to facilitate control of proppant delivery. The proppant groups are delivered by the conveyor 14 as indicated by arrow 16 to one or more mixing tanks 18 where the proppant is combined and mixed with a clean hydraulic fracturing fluid 20. The fracturing fluid is continuously delivered from the mixing tank 18 to the wellhead 22 where it is introduced into the formation. By utilizing the combination of the metering unit 12 and a conveyor 14, the proppant can be delivered from the hopper in discrete, spaced apart proppant groups to the mixing tank. A controllable variable speed conveyor 14 may be used. It should be apparent that the system of FIG. 2 is simplified and other equipment and components, such as pumps, additive streams, etc. would also be incorporated. As can be seen, the size and spacing of the proppant groups is controlled by a combination of the metering unit 12 and the speed conveyor 14. In certain cases, the metering from the hopper 10 may be constant or may be varied, with different amounts of proppant being metered and the time between each metering event being different. In certain embodiments, the timing between opening and closing of the metering unit 12 may be 5 seconds or less, but may also be longer. Additionally, the metering events from the hopper 10 may remain generally constant but the speed of the conveyor may be varied, started and stopped. Other combinations employing the hopper metering and the conveyor speed and starts and stops may be used.

Figure 3:
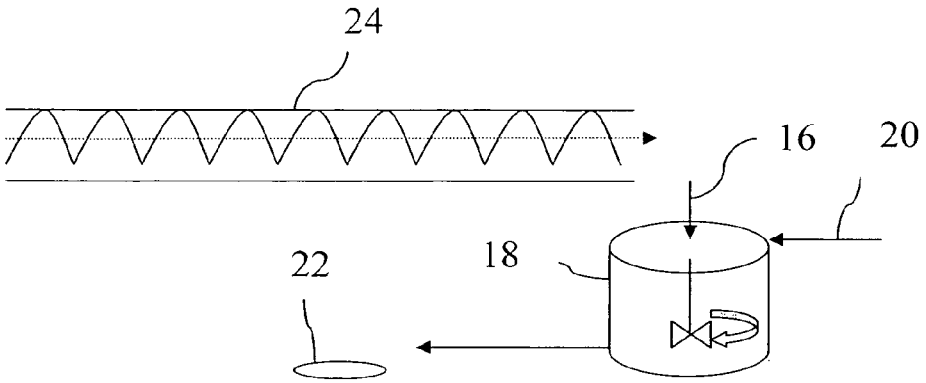
FIG. 3 is a schematic of an auger conveyor proppant feeding system for delivering proppant in pulses in a fracturing fluid.

Referring to FIG. 3, an alternate embodiment of a proppant delivery system is shown that utilizes an auger conveyor 24, with similar components to those of FIG. 2 being labeled with the same reference numerals. The auger conveyor 24 is a variable speed rotating or screw-type auger conveyor that can be operated at various speeds and repeatedly stopped and started. The auger 24 may be horizontal or tilted and may have a sufficient capacity to provide the desired amount of proppant based upon the pumping rate and the desired amount of proppant needed for each stage. The auger conveyor 24 has an outlet or discharge that discharges conveyed proppant to the mixing tank 18 where it is combined with clean fracturing fluid 20, the auger being rotated and fully stopped at intervals to provide discrete proppant groups that are discharged to the mixing tank 18. The auger 24 may be started and stopped at intervals of from 5 seconds or less. In certain embodiments more than one auger conveyor may be used to feed proppant. By alternating starting and stopping of the auger 24, proppant and clean stages of fracturing fluid are created that flow from the mixing tank 18 and are delivered to the wellhead 22. In certain embodiments, the auger 24 may be combined with the embodiment of FIG. 2, wherein proppant is delivered to the auger 24 by the hopper 10 using a metering unit 12.

In a typical fracturing operation, the fracturing fluid may be pumped at a flow rate of from about 5 to 200 barrels (bbl) per min (0.79 $m^3$ to 31.80 $m^3$ per min). In typical hydraulic fracturing operations, the pumping rate may be from about 5 to about 50 bbl/min (0.79 to 7.95 $m^3$/min). In fracturing shale or tight formations, the water or slickwater may be pumped at a higher rate of from about 50 to about 150 or 200 bbl/min (7.95 to 23.85 or 31.80 $m^3$/min). In providing the alternating proppant slug and clean fluid stages using the systems of FIGS. 2 and 3 and other systems described herein, the proppant is delivered to or with the fracturing fluid to provide alternating proppant and clean fluid stages that have a duration of less than 60 seconds each at the given fracturing treatment pumping rate. In certain embodiments, the proppant is delivered to provide a proppant stage that is 40 seconds or less. In some embodiments, the proppant stage may have durations of 30 to 40 seconds, 20 to 30 seconds, 10 to 20 seconds and 5 to 10 seconds. In certain embodiments, the proppant delivery may provide a duration of less than 5 seconds at the given pump rate. Such a short duration may facilitate the creation of proppant pulses that are as close as possible to the ideal proppant pulse A, as is shown in FIG. 1. The duration of the proppant stages may range from greater than 0% to 10%, 15%, 20%, 25% or 30% of the duration of the clean fluid stages. As an example, employing the system of FIG. 2, at a pumping rate of 20 bbl/min (3.18 $m^3$/min) the metering unit may be open 5 seconds to meter proppant and then closed for 15 seconds with a generally constant conveyor speed. This may be repeated. The number of cycles of alternating clean and proppant stages may range from about 10 to about a few thousand (e.g. 2000) cycles or more for a fracturing treatment.

For the embodiments of FIGS. 2 and 3, the proppant feeding system may require calibration of the equipment because of non-ideal proppant pulse shapes, as shown in FIG. 1. Calibration or recalibration may be conducted by proppant totalization and comparison with the proppant amount according to a schedule. Thus, for example, if less proppant is pumped than expected, the amount of proppant metered maybe increased. Correction coefficients for gate position, belt speed or auger rotation speed may be calculated based upon the calibration. The correction coefficient may differ for different proppant concentrations. For example, the term K-factor is used to refer to the conversion of drive revolutions (such as auger rotations) to the calculated fluid rate. The higher the proppant concentration the closer are K-factors of pulse regime to K-factors of conventional continuously feeding proppant regimes. At lower proppant concentrations, greater adjustments to the K-factor may be useful to calibrate amount of proppant calculated to the amount of proppant pumped.

Figure 4:
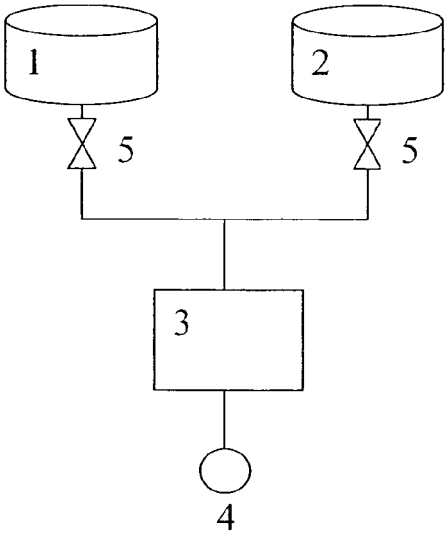
FIG. 4 is a schematic of a pumping system for pumping alternating proppant-laden and clean fluids to a wellhead using control valves to form proppant slugs.

In other embodiments, proppant pulses are provided by utilizing a pre-mixed proppant slurry along with a clean fluid. Referring to FIG. 4, an illustration of one such embodiment is shown. In this embodiment, a clean fluid from a tank or clean fluid supply 1, which may be a pre-mixed fracturing fluid, is alternated with a pre-mixed proppant slurry from proppant slurry tank or supply 2 is delivered by one or more high pressure pumps 3 to the wellhead 4. The fluids used for the clean and pre-mixed proppant slurries may be the same or different. For example, if different, the different fluids may contain different additives or different relative amounts. One of the fluids may be crosslinked while the other may be linear, the clean fluid may be a foam while the proppant fluid may be a water-based fluid, the clean fluid may be or contain nitrogen or carbon dioxide while the proppant fluid is a viscosified fluid, etc. The viscosity of the fluid for the clean fluid and proppant fluid stages may he the same or different. Fiber may be added to the clean fluid and the proppant fluid stage or only to the proppant fluid stage. Additives, such as surfactants, or on-the-fly tackifiers, may be added to the proppant fluid stage only. The pre-mixed proppant slurry is also formed from a pre-mixed fracturing fluid, which may be the same or different from that used for the clean fluid. In those embodiments described herein employing a pre-mixed proppant slurry, the pre-mixed proppant slurry may be formed from conventional systems used to form proppant-containing fracturing fluids that utilizes a continuous proppant feeding system. In other embodiments, systems such as those of FIGS. 2 and 3 may be used to provide pre-mixed proppant slurries with pulses of proppant within the pre-mixed proppant slurry or that may have continuous proppant feed but wherein the amount of proppant various within the pre-mixed slurry. A pre-mixed proppant slurry may be injected or pulsed into a clean slurry or a clean slurry may be injected or pulsed into a pre-mixed proppant slurry in certain embodiments. The alternating clean and proppant stages from the supplies 1 and 2 are controlled through the use of control valves 5 for regulating the clean and proppant-containing fluids. Valves 5 represent a mechanism such as a valve that is used to regulate flow from different sources. Operation may range from manual to fully-automated use. The valves 5 will typically be provided on the low pressure side of the high pressure pump 3 for ease of control and for safety. In certain embodiments, the valves 5 may be on the high pressure side of pumps 3. In such cases, a pump would be provided for each fluid supply. In the embodiment shown, the pump 3 pumps fluid generally continuously, while the valve 5 to clean slurry supply 1 is open. The valve 5 to clean slurry supply 1 is then closed or partially closed while the valve 5 to pre-mixed proppant slurry supply 2 is opened or opened further. The timing of the opening and closing of the valves 5 may be configured so that the proppant slug is as ideal as possible. Opening one valve at the same time another valve is closed reduces the risk for cavitation. In certain cases there may be some overlap in the opening and closing of the valves 5 or only partial closing of the valves 5 to each supply of fluid to ensure that fluid is continuously supplied to the pump 3 may be permissible. In certain case, there may be only partial closing of the valves 5 and each supply of fluid continues. In such cases, the clean fluid slug may contain some proppant but at a much lower concentration. The same type and timing of proppant slug profiles as described previously may also be used, with the same or similar durations and with same number of cycles.

Figure 5:
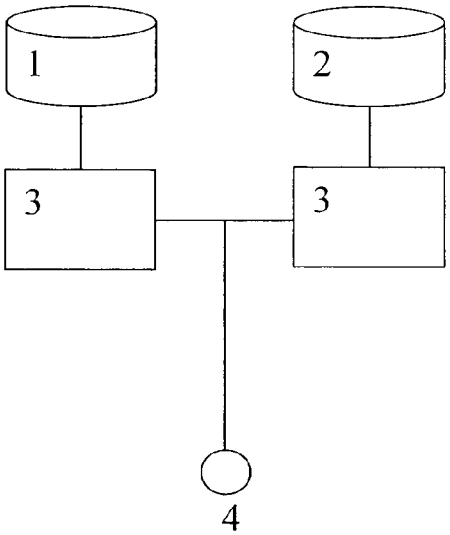
FIG. 5 is a schematic of a pumping system for pumping alternating proppant-laden and clean fluids to a wellhead using separate pumps to form proppant slugs.

FIG. 5 shows a variation of the embodiment of FIG. 4 wherein similar components are labeled with the same reference numerals. In FIG. 5, separate high pressure pumps 3 are used with each of the clean and pre-mixed proppant slurries 1 and 2. The pumps 3 may be centrifugal pumps. By alternating the discharge or discharge rate from each of the pumps 3, proppant slugs may be created for the fracturing fluid, which is introduced into the well through the wellhead 4. Alternative methods for providing separate streams of clean fluid or water and proppant carrying fluids for combined use in a fracturing fluid are described in U.S. Patent Application Publications US20080066911 and US20070277982, each of which are incorporated herein in their entirety.

Figure 6:
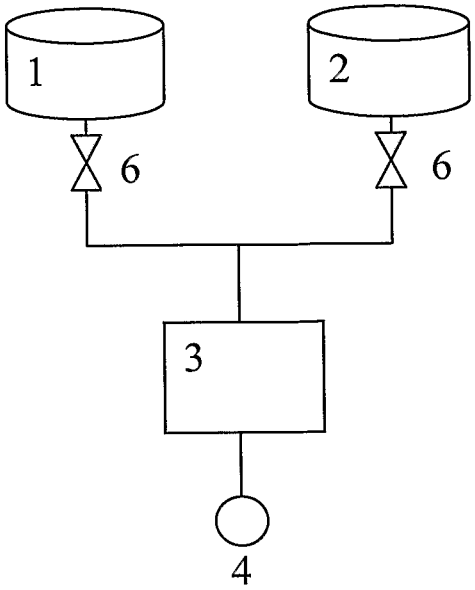
FIG. 6 is a schematic of a pumping system for pumping alternating proppant-laden and clean fluids to a wellhead using back pressure regulator control valves with both the proppant-laden and clean fluids to form proppant slugs.

Referring to FIG. 6 another embodiment is shown that employs a pre-mixed proppant slurry and a clean fluid. The embodiment of FIG. 6 is similar to that of FIG. 4 with similar components labeled the same. In this embodiment, back pressure control devices such as diaphragms or regulator valves 6 are used to control the delivery of proppant slurry and/or clean fluid to high pressure pump 3. Opening of one of the valves 6 may be in response to a preselected flow rate or pressure differential being reached, wherein the valve 6 is then opened to allow flow of the proppant slurry or clean fluid. The size of the proppant slug and clean fluid volume is controlled by the pump(s) 3 suction rates. The valves 6 for each of the proppant slurry and clean fluid could be operated simultaneously or separately.

Figure 7:
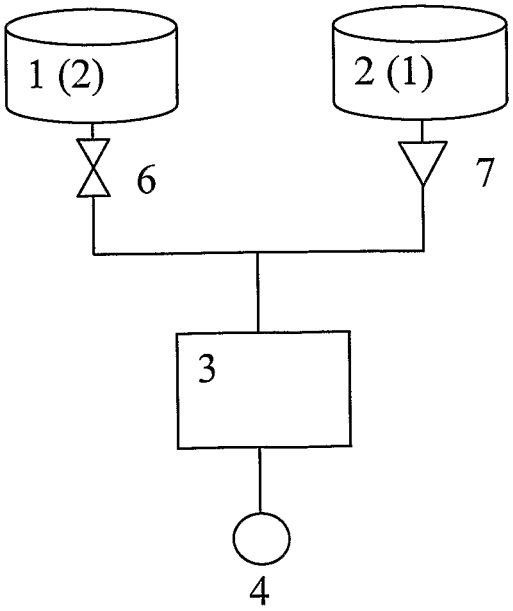
FIG. 7 is a schematic of a pumping system for pumping alternating proppant-laden and clean fluids to a wellhead using a back pressure regulator control valve with one of the proppant-laden fluid and clean fluids and a check valve used with the other fluid to form proppant slugs.

FIG. 7 shows a variation of the embodiment of FIG. 6, with similar components labeled with the same reference numerals. In this embodiment, back pressure regulator valve 6 is used with one of the clean fluid or proppant slurry supplies 1 or 2. The other clean fluid or proppant slurry is provided with a non-back pressure regulator valve 7. The valve 7 may be a check valve, a diaphragm, or other device that controls the fluid flow to the pump 3. The size of the proppant slug or clean fluid slug is controlled by the pump suction rate with the help of the valve 7, which controls the flow of fluid from the other of the clean or proppant fluid.

In another embodiment, clean fluid may be injected or pulsed into a proppant fluid flow line, proppant fluid may be injected or pulsed into a clean fluid flow line, or clean fluid and proppant fluid in alternating or varying concentrations may be injected or pulsed in a common flow line to provide slugs of proppant fluid and clean fluid. This injection of one fluid into the flow line of another fluid may be accomplished through one or more valves in the flow line.

Figure 8:
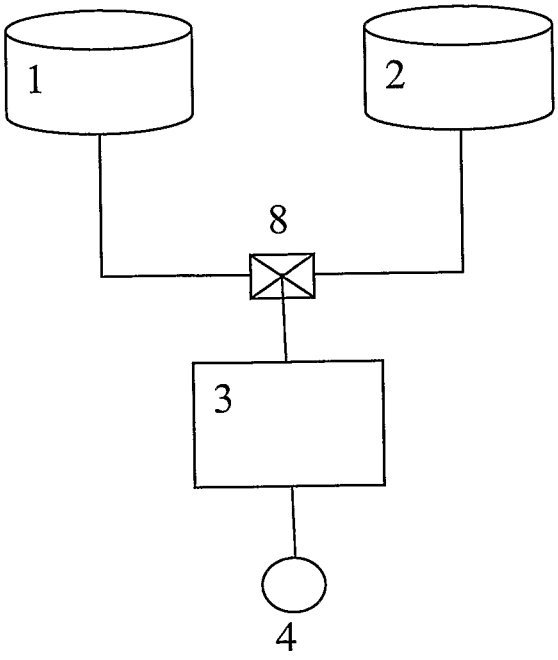
FIG. 8 is a schematic of a pumping system for pumping alternating proppant-laden and clean fluids to a wellhead using a three-way valve with one of the proppant-laden fluid and clean fluids and a check valve used with the other fluid to form proppant slugs.
Figure 9:
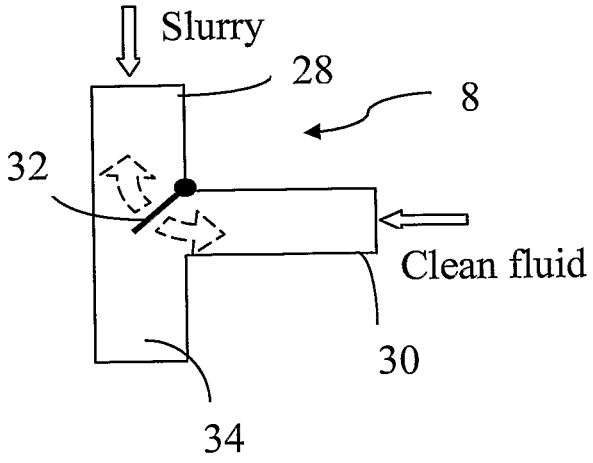
FIG. 9 is a schematic of a three-way valve that may be used with pumping system of FIG. 8.

FIG. 8 illustrates still another embodiment of a system for pumping alternating proppant slugs and clean fluid. In this embodiment, fluid flow from the clean and proppant fluid sources 1 and 2 to the high pressure pump 3 are controlled by a three-way valve 8. FIG. 9 shows an example of the three-way valve 8 that has two inlets 28, 30, one for each of the clean fluid and proppant slurry. A closure 32 regulates the flow between each of the inlets to stop or adjust the volume of flow through each of the inlets 28, 30 and allows the simultaneous control of each of the fluids. The position of the valve closure 32 may be controlled so that flow is allowed through both inlets to provide a desired density of the proppant slurry based upon volumetric calculations. The outlet 34 of the three-way valve 8 is discharged to the pump 3 or to the wellhead, as the case may be. The valve 8 can be remotely controlled. A high pressure pump 3 may also be located on each of the clean fluid and proppant slurry lines, with the valve 8 being located on the high pressure side of such pumps. In many cases, however, the valve 8 will be on the low pressure side of the pump 3.

Figure 10:
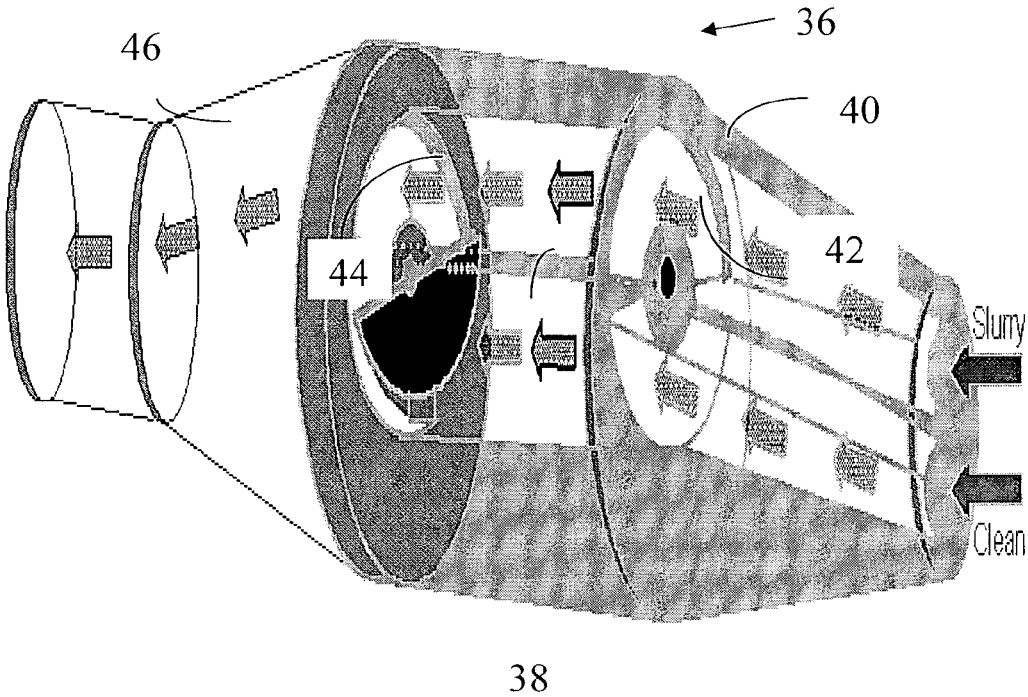
FIG. 10 is a perspective view of a three-way valve configured for use with the pumping system of FIG. 8.

FIG. 10 illustrates another example of a three-way valve 36 that may be used with the system of FIG. 8. The valve 36 includes a valve body or housing 38 that may have a generally cylindrical or barrel-shaped configuration or portion, as shown. At least two fluid passages 40, 42 are provided in the valve body 38 for allowing the flow of proppant slurry and clean fluid, respectively. The flow passages 40, 42 may be substantially parallel to one other. In the embodiment shown, the fluid passages 40, 42 formed in the body 38 may each have a generally semicircular or other partial circular transverse cross section, although other configurations could be used. A valve closure 44 is provided within the interior of the valve body 38 and is rotatable about an axis that is generally parallel to the fluid flow through the fluid passages 40, 42 to selectively open and close the fluid passages 40, 42. In the embodiment shown, the closure 44 is configured as a generally semicircular or other partial circular-shaped plate or member that is configured for closing off each of the semicircular flow passages 40, 42. The rotation of the closure 44 may be effected through mechanical, hydraulic, magnetic or other actuation and may be controlled remotely. By rotation of the closure 44, the degree of fluid flow through each of the passages 40, 42 can be controlled so that variable amounts of each of the fluids may be delivered to an outlet 46 of the valve 36 or alternate delivery of the fluids may be delivered when each of the passages 40, 42 is alternately opened and closed.

Figure 11:
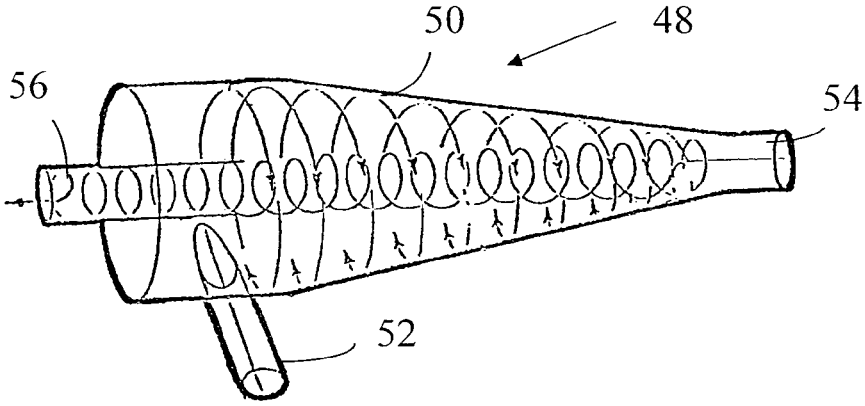
FIG. 11 is a schematic of a hydrocyclone separator for use in providing a proppant-laden

In another embodiment, a hydrocyclone separator or concentrator is utilized for delivering alternate pre-mixed proppant slurry and clean fluid. FIG. 11 shows an example of a hydrocyclone separator 48. The separator includes a generally conical- or frusto-conical-shaped body or housing 50 having a tangential fluid inlet 52 where a proppant slurry is introduced at a high flow rate. The flow of fluid through the tangential inlet 52 causes the proppant particles to be thrown through centrifugal force to the sidewalls of the housing interior where they spiral downward to an underflow outlet 54, which may be provided with a control valve (not shown) for controlling the flow out of the outlet 54. Lighter fluids and materials move toward the center of the separator where they are directed upwards through a central overflow outlet 56, which may be provided with a control valve (not shown) for controlling the flow out of the outlet 56.

The hydrocyclone separator allows a concentrated proppant slurry to be formed from a diluted proppant slurry. In this way, higher concentrations of proppant in fluid slugs can be formed than through conventional mixers or blenders and pumping equipment. The concentration of proppant is controlled by the inlet slurry proppant concentration, which may be a diluted proppant slurry, and the amount of fluid or material discharged through the underflow outlet 54 and/or overflow outlet 56. Thus, for example, fully closing the outlet 56 so that no fluid is allowed out, a dilute proppant slurry may be provided and delivered to the underflow outlet 54. This diluted proppant slurry may form the clean fluid with very little proppant concentration (e.g. 2 ppa or 0.24 kg/L or less). By opening the fluid outlet 56 to remove fluid from the slurry, a concentrated proppant slurry can be readily formed, which is delivered to the underflow outlet 54. Completely opening the outlet will allow both fluid and proppant to exit through the underflow outlet. Chokes are required to hold enough back pressure to allow fluid to return while the concentrated slurry exits through the overflow outlet. The proppant concentration can be significantly and immediately increased or decreased by the amount of fluid removed through the outlet. By alternately opening and closing the overflow outlet 56, alternating clean fluid and proppant slurry slugs can be formed for delivery to the wellbore. Alternatively, clean and proppant slurry may be delivered through the overflow outlet 56 by adjusting through the flow through underflow outlet 54. Thus, the clean and/or proppant slurries may be provided from either outlets 54, 56 of the separator 48. Removed streams that are not introduced into the formation may also be recycled. The hydrocyclone provides a quick and efficient method for providing such alternating clean and proppant slurry slugs. Additionally, good control of the proppant concentration, which can be almost instantaneous, can be achieved through the use of the hydrocyclone. In other embodiments, the hydrocyclone 48 may be used solely for forming high concentration pre-mixed proppant slurries, as in the embodiments previously discussed, with the clean fluid being supplied from a separate source.

In still another embodiment, the alternating proppant and clean fluid slugs may be formed from a piston pump that periodically injects a pre-mixed proppant slurry into a clean fluid. The pump (not shown) may be a multi-plunger or piston pump, such as a tri-plea plunger or piston pump (3 pistons), wherein one of two or more pistons or cylinders is used to pump or inject the pre-mixed proppant slurry into the clean fluid.

With each of the embodiments described herein, it should be noted that various equipment and devices not specifically discussed may be employed with each of the systems. Such equipment may include flowmeters, densitometers, pressure gauges, etc. Additionally, those systems utilizing pre-mixed proppant slurries may employ re-circulating lines and pumps for recirculating the pre-mixed proppant slurry to facilitate suspension of the proppant. Recirculation of the clean slurry could also be used. The recirculation may be provided on the low pressure sick of the system.

With respect to the methods described herein wherein alternating clean and proppant fluid slugs are used, it should be noted that non-proppant fibers and particulate materials may also be incorporated in each of the clean and/or proppant-containing fluids. Such materials may be used to facilitate suspension of the proppant to prevent proppant settling and to reduce the amount of viscosifying agent required. Examples of this are described in U.S. Patent Application Publication No. US2008/0135242, which is herein incorporated by reference in its entirety. In the heterogeneous proppant placement, the non-proppant particulate material used to stabilize and suspend the proppant and/or provide the liquid-liquid interface may be contained in one or both such adjacent interfacing fluids. The particulate material may be admixed continuously with the fracturing fluids, while the proppant may be added in pulses. In some embodiments, the proppant-free fluids or pulses may have a higher content of the non-proppant particulate material. In other embodiments, the proppant-laden fluids or pulses may have a higher content of non-proppant particulate material. In still other embodiments, the amount of non-proppant particulate material may be generally the same in both the proppant-free and proppant-laden fluids and be generally continuously dispersed throughout the fluids.

The systems and methods described herein for alternating proppant and clean fluid slug delivery may also be used in conjunction with particular perforation strategies. Such perforation strategies may include the formation of spaced apart perforation clusters. Examples of such perforation strategies are described in International Publication Nos. WO2009/005387 and WO2009/096805, each of which is incorporated herein by reference in its entirety.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A method of placing a proppant pack into a fracture that extends from a wellbore formed in a subterranean formation, the method comprising:

performing at least one of the following to facilitate providing multiple spaced apart proppant slugs within a hydraulic fracturing fluid that is introduced into the wellbore at a pressure above the fracturing pressure of the formation:

(1) providing a hopper containing proppant having a controllable metering unit that can be opened and closed between closed and variable open positions, the metering unit selectively metering proppant from the hopper to a conveyer in discrete, spaced apart proppant groups, the proppant groups being delivered by the conveyer to a mixing tank where the proppant is combined with the hydraulic fracturing fluid, and wherein the size and spacing of the proppant groups is controlled by a combination of the metering unit and the speed of the conveyor;

(2) providing proppant to a variable speed rotating auger conveyor, the auger conveyor having a discharge that discharges conveyed proppant to a mixing tank, the auger being rotated and fully stopped at intervals to provide discrete proppant groups that are discharged to the mixing tank; and (3) providing a proppant in a pre-mixed proppant slurry and a clean fluid that form the fracturing fluid and pulsing one of the pre-mixed proppant slurry and clean fluid into the other;

forming high concentration pre-mixed proppant slurries by using hydrocyclones;

wherein the pulsing one of the pre-mixed proppant slurry and clean fluid into the other is accomplished by the use of a three-way valve.

2. The method of claim 1, wherein:

the pre-mixed proppant slurry and the clean fluid are each pumped through different pumps.

3. The method of claim 1, wherein:

the pre-mixed proppant slurry and the clean fluid are each pumped through the same pump.

4. The method of claim 1, wherein:

wherein the three-way valve comprises:

a valve housing having at least two flow passages, each flow passage allowing the passage of one of the proppant slurry and the clean slurry; and a valve closure that rotates about an axis substantially parallel to the fluid flow through the passages to selectively close the fluid passages.

5. The method of claim 1, wherein:

a diluted proppant slurry is introduced into an inlet of a hydrocyclone separator, the hydrocyclone separator having an underflow outlet and overflow outlet wherein the pre-mixed proppant slurry is provided from at least one of the underflow outlet and overflow outlet.

6. The method of claim 5, wherein:

the clean fluid is formed from the diluted proppant slurry and the multiple spaced apart proppant slugs are provided by controlling the flow of fluid through at least one of the underflow outlet and the overflow outlet.

7. The method of claim 1, wherein:

the pre-mixed proppant slurry is delivered by a piston pump.

8. A method of placing a proppant pack into a fracture that extends from a wellbore formed in a subterranean formation, the method comprising:

providing a proppant in a pre-mixed proppant slurry and a clean fluid that form the fracturing fluid and pulsing one of the pre-mixed proppant slurry and clean fluid into the other to facilitate providing multiple spaced apart proppant slugs within a hydraulic fracturing fluid that is introduced into the wellbore at a pressure above the fracturing pressure of the formation;

forming high concentration pre-mixed proppant slurries by using hydrocyclones;

wherein the pulsing one of the pre-mixed proppant slurry and clean fluid into the other is accomplished by the use of a three-way valve.

9. The method of claim 8, wherein:

the pre-mixed proppant slurry and the clean fluid are each pumped through different pumps.

10. The method of claim 8, wherein:

the pre-mixed proppant slurry and the clean fluid are each pumped through the same pump.

11. The method of claim 8, wherein:

wherein the three-way valve comprises:

a valve housing having at least two flow passages, each flow passage allowing the passage of one of the proppant slurry and the clean slurry; and a valve closure that rotates about an axis substantially parallel to the fluid flow through the passages to selectively close the fluid passages.

12. The method of claim 8, wherein:

a diluted proppant slurry is introduced into an inlet of a hydrocyclone separator, the hydrocyclone separator having an underflow outlet and overflow outlet wherein the pre-mixed proppant slurry is provided from at least one of the underflow outlet and overflow outlet.

13. The method of claim 12, wherein:

the clean fluid is formed from the diluted proppant slurry and the multiple spaced apart proppant slugs are provided by controlling the flow of fluid through at least one of the underflow outlet and the overflow outlet.

14. The method of claim 8, wherein:

the pre-mixed proppant slurry is delivered by a piston pump.

15. A method of fracturing a subterranean formation comprising:

pumping at sufficient pressure to fracture the subterranean formation a fracturing fluid comprising multiple proppant slugs spaced apart, wherein the proppant slugs are provided by performing at least one of:

(1) providing a hopper containing proppant having a controllable metering unit that can be opened and closed between closed and variable open positions, the metering unit selectively metering proppant from the hopper to a conveyer in discrete, spaced apart proppant groups, the proppant groups being delivered by the conveyer to a mixing tank where the proppant is combined with the hydraulic fracturing fluid, and wherein the size and spacing of the proppant groups is controlled by a combination of the metering unit and the speed of the conveyor;

(2) providing proppant to a variable speed rotating auger conveyor, the auger conveyor having a discharge that discharges conveyed proppant to a mixing tank, the auger being rotated and fully stopped at intervals to provide discrete proppant groups that are discharged to the mixing tank; and (3) providing a proppant in a pre-mixed proppant slurry and a clean fluid that form the fracturing fluid and pulsing one of the pre-mixed proppant slurry and clean fluid into the other;

forming high concentration pre-mixed proppant slurries by using hydrocyclones;

wherein the pulsing one of the pre-mixed proppant slurry and clean fluid into the other is accomplished by the use of a three-way valve.

16. The method of claim 15, wherein:

the proppant slugs are placed in the fracture formed in the subterranean formation.

* * * * *